United States Patent [19]

Eisenhauer

[11] 4,059,846

[45] Nov. 22, 1977

[54] LIFT WITH ELECTRICAL GROUNDING MEANS

[75] Inventor: Leigh E. Eisenhauer, Van Wert, Ohio

[73] Assignee: The Eisenhauer Manufacturing Company, Van Wert, Ohio

[21] Appl. No.: 648,168

[22] Filed: Jan. 12, 1976

[51] Int. Cl.[2] ..... H05F 3/02

[52] U.S. Cl. ..... 361/212; 361/218; 361/219

[58] Field of Search ..... 317/2 E, 2 D, 2 R; 294/74, 67 E; 244/137 P; 361/212, 218, 219

[56] References Cited

U.S. PATENT DOCUMENTS

| | | | |
|---|---|---|---|
| 3,416,033 | 12/1968 | Hoover et al. | 317/2 R |
| 3,887,953 | 6/1975 | Eisenhauer | 244/137 P X |

FOREIGN PATENT DOCUMENTS

| | | | |
|---|---|---|---|
| 571,436 | 3/1959 | Canada | 294/67 E |

*Primary Examiner*—Harry E. Moose, Jr.
*Attorney, Agent, or Firm*—Whittemore, Hulbert & Belknap

[57] ABSTRACT

A device for suspending a raft from a transport such as a helicopter so that the raft can be lowered and raised into and out of the water without subjecting persons attending or occupying the raft to an electric shock from a static charge that may be carried by the transport. The device comprises a metal plate attachable to the transport having straps provided with snap fasteners releasably attachable to the raft. A ground wire connected to the plate is sufficiently longer than the straps so as to contact the water and ground the transport before the straps contact the raft.

1 Claim, 4 Drawing Figures

LIFT WITH ELECTRICAL GROUNDING MEANS

BACKGROUND AND SUMMARY OF THE INVENTION

In my prior U.S. Pat. No. 3,887,953, a raft is disclosed which is adapted for use as a water rescue or recovery litter. The raft is intended for use primarily by stand-by units on duty at power boat races to facilitate the safe and speedy rescue of injured drivers. When used for this purpose, the raft may be dropped from a helicopter at the site of the emergency. After the injured driver is placed aboard the raft, the raft may be picked up by the helicopter and transferred to an ambulance or to a hospital.

One of the dangers in picking a raft up out of the water by a helicopter is the possible transmission of a static charge of electricity from the helicopter to the raft. The helicopter will normally generate a substantial charge which if not grounded can do serious harm to persons in contact with the raft.

Accordingly, one of the objects of the invention is to provide a device by means of which a raft may be picked up out of the water which will ground the electricity and dissipate any static charge without subjecting the raft or its occupants or its attendants to an electric shock.

Another object of the invention is to provide a device for suspending a raft from a helicopter having straps for picking up the raft and a ground wire which is sufficiently longer than the straps so as to contact the water and ground the helicopter before the straps contact the raft.

Other objects and features of the invention will become more apparent as the description proceeds, especially when taken in conjunction with the accompanying drawing, wherein.

Figure 1:
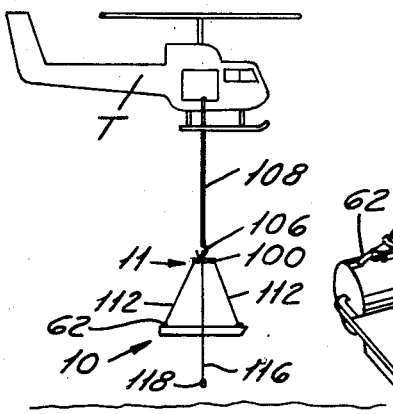
FIG. 1 is a perspective view on a reduced scale of a raft or litter being lifted out of the water by a helicopter, the suspension device of my invention being shown suspending the raft from a hook on the end of a helicopter cable.
Figure 4:
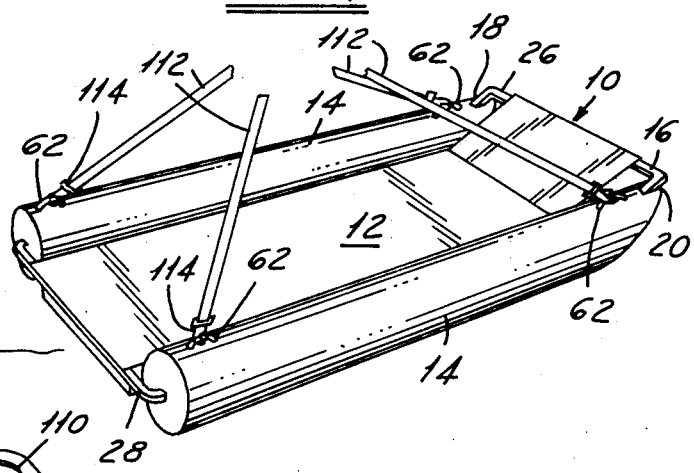
FIG. 4 is a perspective view of the raft suspended from the straps of the suspension device.

Referring now more particularly to the drawing, the raft is generally designated 10 and is adapted to be suspended from a helicopter or other transport T by a suspension device 11.

The raft 10 may be of any suitable construction although for use as a water rescue or recovery litter I prefer the construction shown in my prior patent 3,887,953 which is incorporated herein by reference. The raft will hereinafter by described only briefly, it being understood that a complete description and illustration is provided in my prior patent.

The raft 10 comprises a body section 12, pontoons 14 and a frame structure 16 tying the body section 12 and pontoons 14 together as a unit.

The frame structure 16 may be of any suitable construction but preferably is made of lightweight durable aluminum tubing. The frame structure includes the parallel longitudinally extending, laterally spaced generally parallel frame members 18 and 20 and the front and rear parallel transverse frame members 26 and 28 which extend at right angles to the longitudinal frame members and are connected end to end thereto generally in the form of a rectangle. The pontoons 14 are elongated cylindrical members which are preferably molded of a suitable material such as polyurethane. The longitudinal frame members 18 and 20 extend through and are embedded in the pontoons. This may be accomplished by initially splitting the pontoons in half longitudinally, and then assembling the split halves together by an adhesive such, for example, as epoxy glue.

The body section 12 is of generally rectangular box form, the ends of which are secured by any suitable means as by an epoxy type adhesive to the transverse front and rear frame members 26 and 28. For additional support of the body section, longitudinally extending generally parallel frame members inwardly of the frame members 18 and 20 may be provided and terminally connected to the transverse front and rear frame members 26 and 28. These inner frame members are not shown herein but are fully described in my aforesaid patent. The side edges of the body section are secured as by epoxy glue to these inner frame members for additional support.

The raft is provided with anchor brackets 62 which are spaced apart longitudinally of each pontoon. Such brackets are generally U-shaped and have their legs welded or otherwise rigidly secured to the frame members 18 and 20 and have their closed loop portions projecting outwardly through the surfaces of the pontoons. These anchor brackets are provided for lowering and raising the raft into and out of the water.

The suspension device of my invention comprises a flat metal plate 100 of electrically conductive material having an upright bracket 102 permanently secured as by welding to the midpoint of the top surface of the plate. The bracket 102 is formed with an aperture 104 by means of which the metal plate may be engaged by the hook 106 on the end of cable 108 depending from the helicopter T. The metal plate is square in outline and has an aperture 110 at each of the four corners.

Flexible linear elements in the form of elongated straps 112 depend from the metal plate. Four straps are shown in this embodiment of the invention, one tied or suitably secured through each of the four apertures 110. The straps 112 are preferably formed of an electrically non-conducting material such, for example, as plastic, leather or fabric. Snap fasteners 114 are provided on the free ends of the straps. These snap fasteners are intended for releasable engagement with the brackets 62 on the raft.

Figure 2:
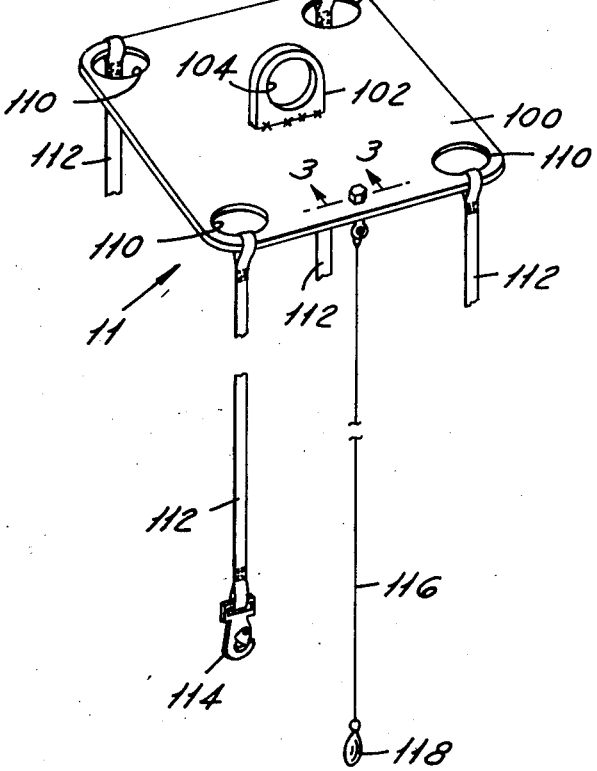
FIG. 2 is an enlarged perspective view of the suspension device.
Figure 3:
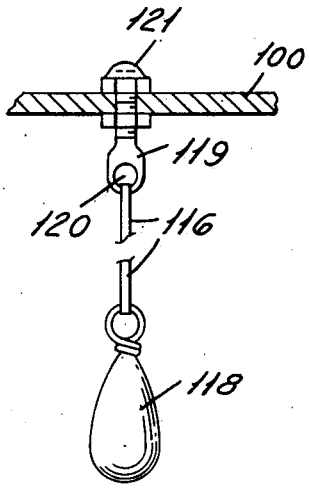
FIG. 3 is a sectional detail taken on the line 3—3 on FIG. 2.

The metal plate also has depending from it a flexible ground wire 116 of electrically conductive material. The ground wire is suitably and preferably permanently secured at one end to the metal plate. For this purpose, there is shown in FIGS. 2 and 3 a bolt 119 having an eye 120 at the lower end through which the ground wire is tied. The bolt 119 passes through the plate and is secured thereto by a nut 121. A weight 118 is secured to the lower end of the wire. It will be noted that the wire 116 is of considerably greater length than the straps 112.

In use as a rescue litter, the raft may be thrown overboard from a boat or from any other transport such, for example, as a helicopter. This of course will be done near the site of the emergency. An injured race boat driver may be placed on the raft and the raft picked up by the helicopter for transfer to a waiting ambulance or to a hospital. In picking up the raft, the suspension device 11 will first be lowered from the helicopter by lowering the cable 108 with the bracket 102 of plate 100 engaged by the cable hook 106 so as to be suspended therefrom. In lowering the suspension device from the helicopter, the straps 112 and ground wire 116 dangle beneath the metal plate 100. The ground wire will hang more or less straight down by reason of the weight 118 on the lower end. By reason of its substantially greater length, the ground wire 116 will contact the water and thus ground the helicopter and discharge any static electric charge before the straps come into contact with the raft or with any of the attendants or the occupant of the raft. Accordingly, any static charge is first dissipated so that the persons involved in the rescue are completely safe. The raft is then attached to the straps 112 by the fasteners 114 so that it can be lifted from the water and taken away from the emergency site.

What I claim as my invention is:

1. A device for suspending a raft from a transport such as a helicopter, which device can be lowered from the transport for attachment to the raft afloat in the water without subjecting persons attending or occupying the raft to an electric shock from a static charge that may be carried by the transport, said device comprising a support formed of electrically conductive material and having a central apertured part in which the hook of a lifting cable from the transport is engageable, flexible linear elements depending from the periphery of said support and releasably attachable to the raft, and a ground wire electrically connected to and depending from said support having a weight on its lower end, said ground wire being sufficiently longer than said linear elements as to contact the water and ground the transport before said linear elements contact the raft.

* * * * *